US005492455A

United States Patent [19]

Durham et al.

[11] Patent Number: 5,492,455

[45] Date of Patent: Feb. 20, 1996

[54] PUMPING APPARATUS INCLUDING A QUICK CONNECT INTERFACE

[75] Inventors: Samuel Durham; Thomas L. Guy, III, both of San Antonio, Tex.

[73] Assignee: Lancer Corporation, San Antonio, Tex.

[21] Appl. No.: 264,435

[22] Filed: Jun. 23, 1994

[51] Int. Cl.[6] ..... F04B 21/02; F04B 35/00

[52] U.S. Cl. ..... 417/313; 417/63; 417/360; 73/168; 137/594

[58] Field of Search ..... 417/313, 63, 360, 417/361; 73/168; 137/594, 884; 251/149.6, 367

[56] References Cited

U.S. PATENT DOCUMENTS

| | | | |
|---|---|---|---|
| 1,450,085 | 3/1923 | Jedlitschka | 417/63 |
| 3,704,002 | 11/1972 | Skarzynski | 251/149.6 |
| 4,142,843 | 3/1979 | Kish | 417/313 |
| 4,203,321 | 5/1980 | Vyse et al. | 73/168 |
| 4,296,777 | 10/1981 | Rodemer | 137/594 |
| 4,331,262 | 5/1982 | Snyder et al. | 73/168 |
| 4,938,251 | 7/1990 | Furrow et al. | 137/594 |
| 5,228,312 | 6/1993 | Williams | 62/390 |

*Primary Examiner*—Charles Freay
*Attorney, Agent, or Firm*—Donald R. Comuzzi; Christopher L. Makay

[57] ABSTRACT

A pump includes a quick connect interface that attaches to any drink dispensing to allow the mounting of the pump without the necessity of connection devices such as threaded fittings and/or clamps. The quick connect interface includes a housing having an inlet port and an outlet port. The inlet port connects to a product source to deliver product into the pump, while the outlet port connects the pump to a product dispensing apparatus. Both the inlet and outlet ports include a flow regulator that prevents the flow of product from the quick connect interface when the pump is removed. The housing also has a gas port that connects to a gas source to deliver gas into the pump. The gas port includes a flow regulator that prevents the escape of gas from the gas source when the pump is removed. Additionally, the pump includes a counter that measures the volume of fluid pumped by the pump.

24 Claims, 4 Drawing Sheets

PUMPING APPARATUS INCLUDING A QUICK CONNECT INTERFACE

BACKGROUND OF THE INVENTION

1. Field of the Invention

The present invention relates to drink dispensing systems and, more particularly, but not by way of limitation, to a pumping apparatus that includes a pump and a quick connect interface that allows quick and easy attachment of the pump to drink dispensing systems.

2. Description of the Related Art

Drink dispensing systems typically include a housing that contains the individual components which permit the dispensing of at least one product. The housing holds a cooling device, such as a cold plate or refrigeration unit, utilized to chill the product before it is dispensed. The housing further holds at least one pump connected between a product source and at least one inlet into the cooling device to deliver product from the product source to the cooling device. The cooling device connects at an outlet to at least one dispensing valve mounted on the housing. Upon its actuation, the dispensing valve draws chilled product from the cooling device and delivers the chilled product from its outlet. The actuation of the dispensing valve also activates the pump so that it delivers product from the product source to the cooling device.

The pump typically employed to pump product from the product source to the cooling device is a gas operated pump. The gas operated pump includes a pair of interconnected diaphragms housed in separate pump chambers. The gas operated pump further includes an inlet connected to the product source, an outlet connected to the cooling device, and a gas inlet that connects to a gas source (e.g., a $CO_2$ bottle) to permit the delivery of gas into the pump chambers. A valve within the gas inlet alternately delivers the gas to the pump chambers to drive the diaphragms in a reciprocating fashion. As the diaphragms reciprocate, they alternately draw product from the product source and then deliver the drawn product to the cooling device.

The product inlet and outlet of the gas operated pump communicate with the product source and cooling device via respective product lines that attach to the product inlet and outlet using a connection device such as a threaded fitting or a clamp. Similarly, the product outlet of the gas operated pump communicates with the gas source via a gas line that attaches to the gas inlet utilizing a connection device such as a threaded fitting or a clamp.

Although the attachment of the gas operated pump using threaded fittings or clamps may be easily accomplished during the initial construction of the drink dispensing system, their use makes any subsequent work on the gas operated pump or its replacement extremely difficult. For example, when the gas operated pump must be removed for fixing or replacement, each of the fittings or clamps must be unscrewed. The unscrewing of the fittings or clamps is time-consuming, especially if the gas operated pump is placed in a relatively inaccessible area within the drink dispensing system housing.

Furthermore, once the product lines are disconnected, any product contained within those lines runs out into the housing, requiring the technician to clean up the spill, and, if the product is a syrup that is allowed to dry, any cleaning of the housing by the technician becomes extremely time-consuming and difficult. Additionally, when the gas line is disconnected, any gas within the gas line is lost and, if the line is not fitted with a check valve, all the gas within the gas source will escape to the atmosphere.

Another problem encountered with pumps utilized to pump product from the product source to the cooling unit involves determining the amount of use of the pump or, in other words, how much product the pump has actually delivered. Pump use is important because it provides a technician with an indication of when the pump should be replaced. Without any pump use indication, pumps are replaced based purely on their age. Consequently, perfectly functioning pumps are replaced due to their age even though their actual use has been very little.

SUMMARY OF THE INVENTION

In accordance with the present invention, a pumping apparatus includes a pump and a quick connect interface that mounts within any drink dispensing system using a suitable means such as screws. The quick connect interface fits within drink dispensing systems to provide a mount for the pump without the necessity of connection devices such as threaded fittings and/or clamps.

The quick connect interface includes a housing having an inlet port and an outlet port. The inlet port connects to a product source via a product line to deliver product into the pump. Similarly, the outlet port connects to a product dispensing apparatus via a product line to deliver product from the pump to the product dispensing apparatus.

The housing also has a gas port that connects to a gas source via a gas line to deliver gas into the pump. The quick connect valve includes the gas port to permit the use of gas powered pumps. Although the gas port has been included, it is not required if the pump is not gas powered pump (e.g., an electric pump).

Both the inlet port and the outlet port include a flow regulator that prevents the flow of product from the product lines when the pump is removed from the quick connect interface. The gas port also includes a flow regulator that prevents the escape of gas from the gas source when the pump is removed.

The inlet port, the outlet port, and the gas port provide the mounting ports for the pump onto the quick connect interface. Additionally, the housing includes at least one protrusion that fits within a cavity in the pump housing to aid the inlet port, the outlet port, and the gas port in supporting the pump.

The pumping apparatus includes a counter that measures the volume of fluid pumped by the pump. The counter measures the strokes of the pump's piston rod or the rotations of the pump's rotor to provide an indication of the volume of product pumped. Since the volume pumped on each piston rod stroke or rotor rotation is a known quantity, the exact volume of all product pumped from the pump may be easily calculated to determine total pump usage.

It is, therefore, an object of the present invention to provide a pumping apparatus including a quick connect interface that eliminates the necessity of connection devices.

It is another object of the present invention to provide a pumping apparatus with a quick connect interface that prevents the leakage of product and gas when the pump is removed.

It is a further object of the present invention to provide a pumping apparatus with a counter mounted on a pump that provides an indication of the total pump usage.

Still other objects, features, and advantages of the present invention will become evident to those skilled in the art in light of the following.

DETAILED DESCRIPTION OF THE PREFERRED EMBODIMENT

Figure 1:
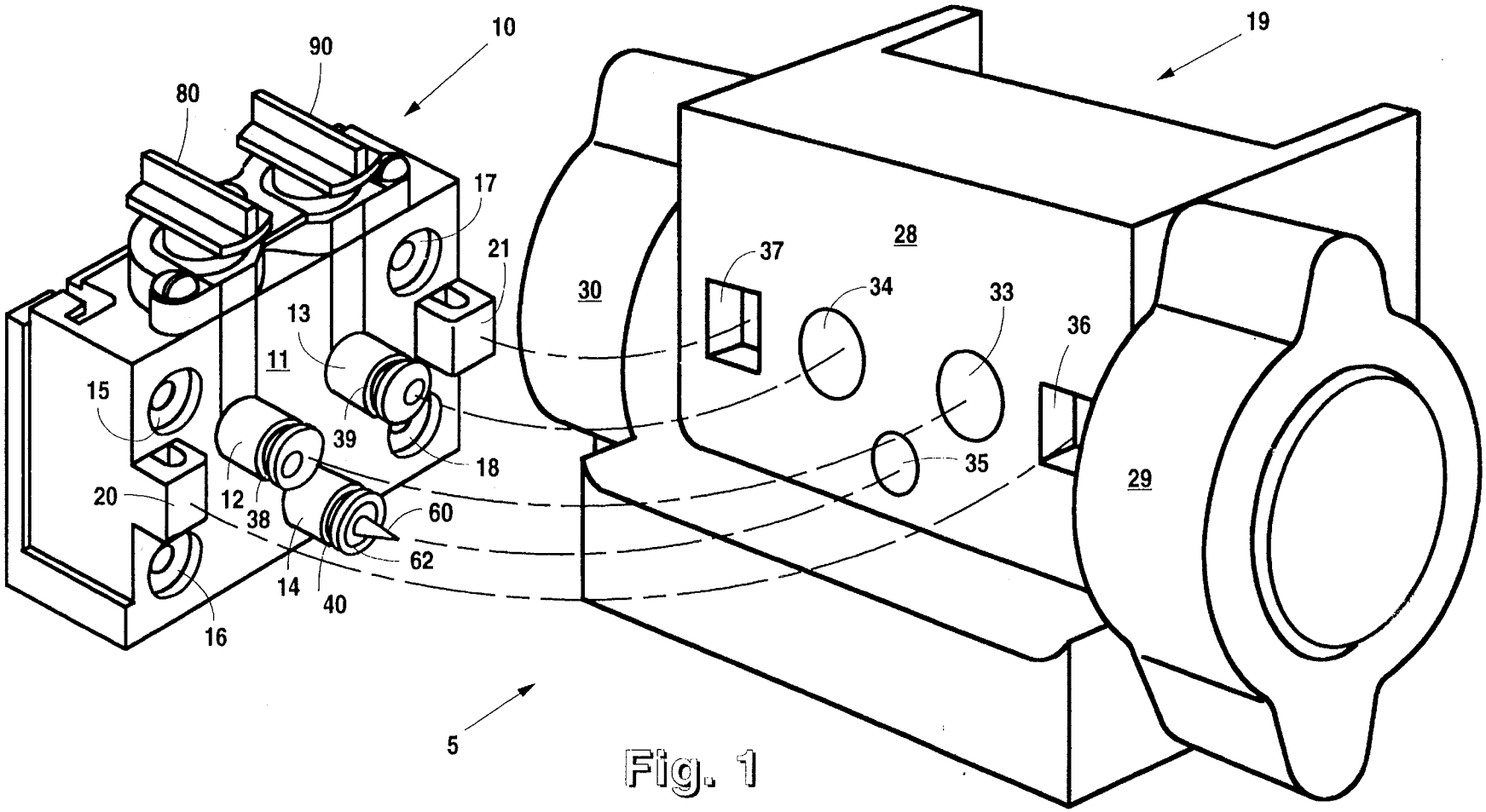
FIG. 1 is a perspective view illustrating a pump and the front of the quick connect interface of the pumping apparatus of the present invention.
Figure 2:
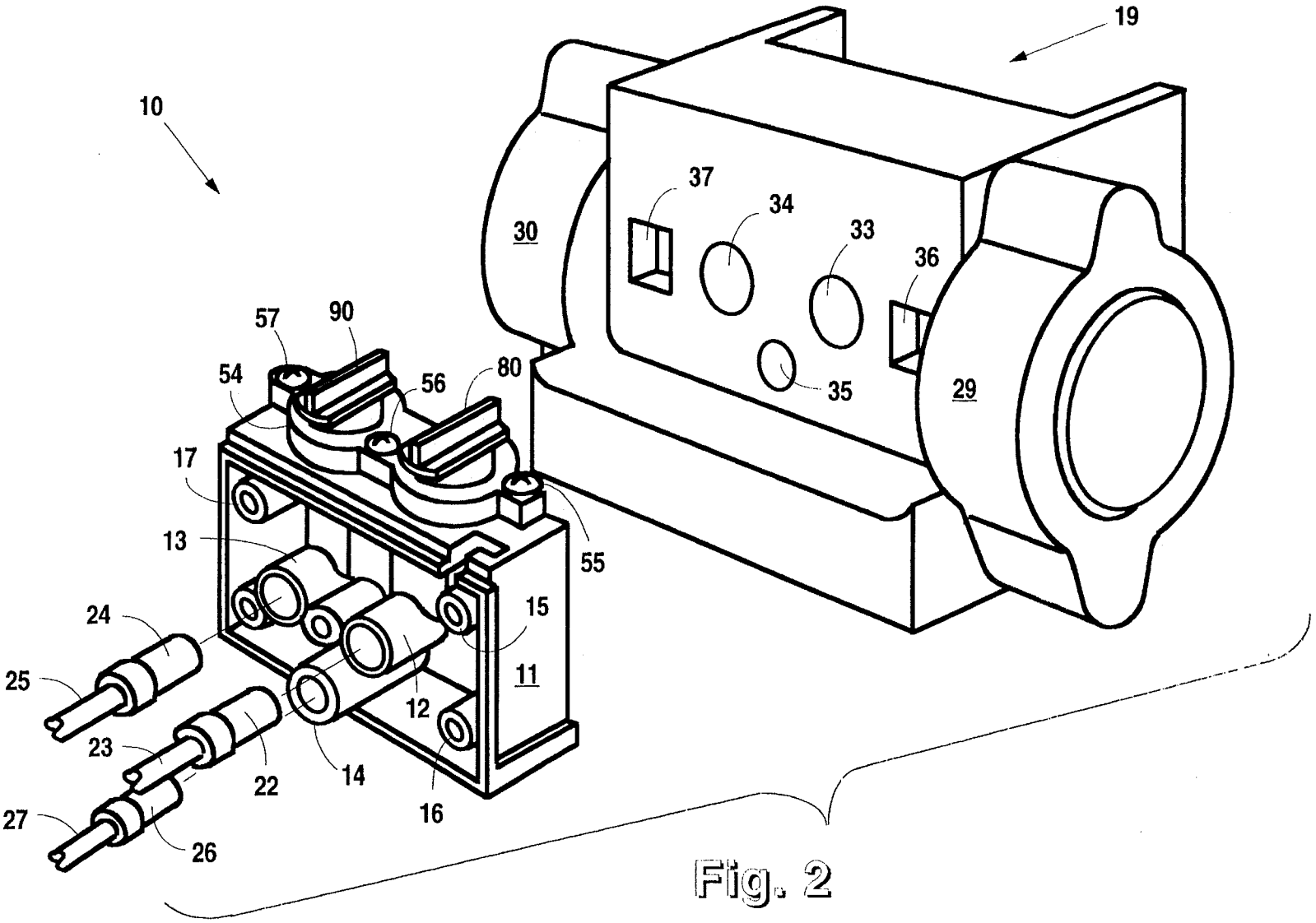
FIG. 2 is a perspective view illustrating a pump and the rear of the quick connect interface of the pumping apparatus of the present invention.
Figure 3:
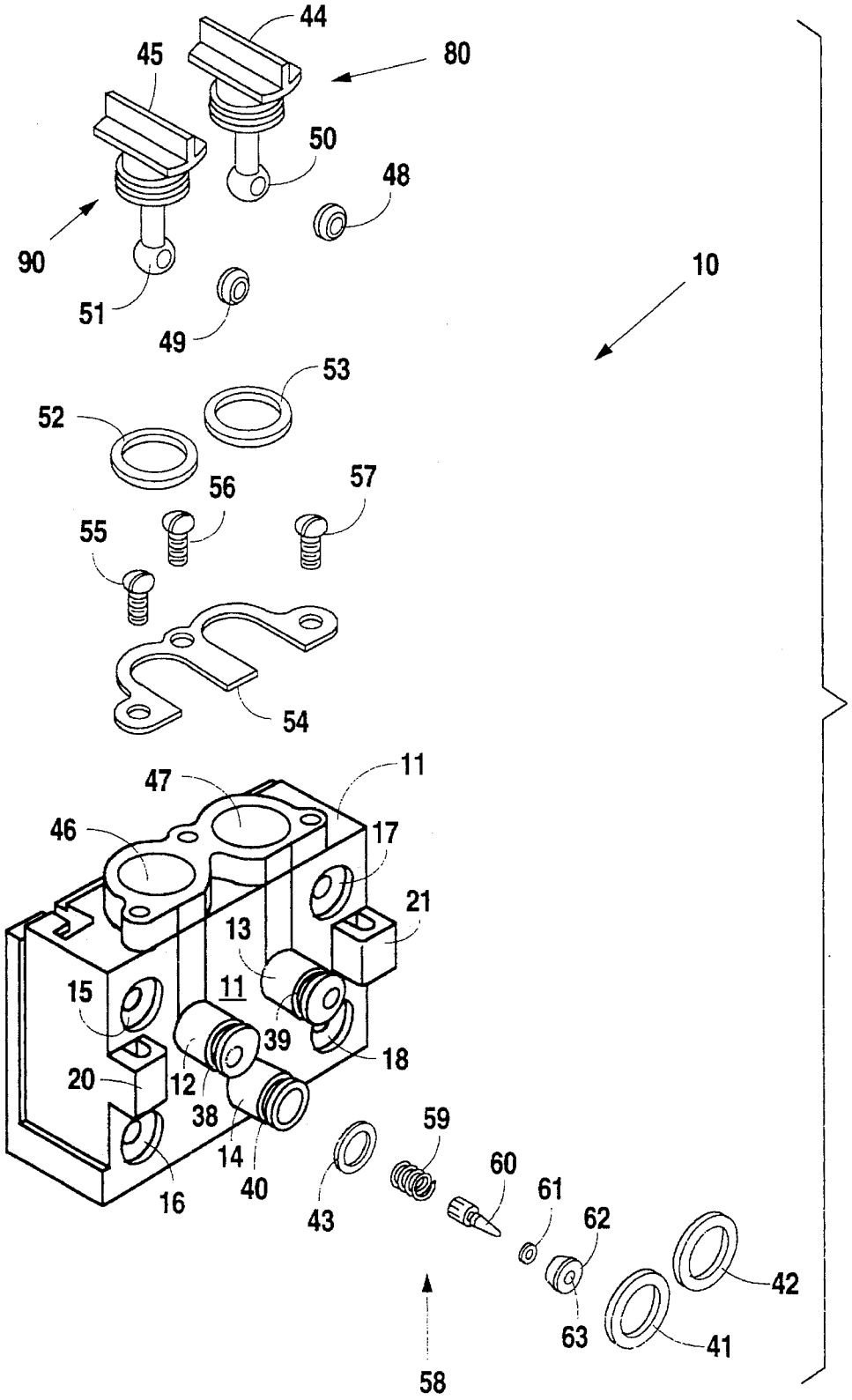
FIG. 3 is an exploded perspective view of the quick connect interface of the pumping apparatus of the present invention.

As illustrated in FIGS. 1–3, pumping apparatus 5 includes pump 19 and quick connect interface 10. Quick connect interface 10 includes housing 11 which, in turn, includes inlet port 12, outlet port 13, and gas port 14. Each one of inlet port 12, outlet port 13, and gas port 14 extend completely through housing 11 to provide a passageway that permits communication between the front and rear of quick connect interface 10. Housing 11 includes holes 15–18 extending therethrough to permit the mounting of housing 11 onto a structure so that quick connect interface 10 will support pump 19. Housing 11 further includes protrusions 20 and 21 which aid inlet port 12, outlet port 13 and gas port 14 in supporting pump 19 on housing 11.

Quick connect interface 10 is employed primarily in drink dispensing systems utilizing a gas driven pump to pump a product from a product source to a cooling device such as a cold plate or a refrigeration unit. Thus, inlet port 12 receives connector 22 which is held within inlet port 12 using any suitable means such as friction or a clamp. Connector 22 couples inlet port 12 to a product source via line 23 to permit the delivery of product into pump 19. Similarly, outlet port 13 receives connector 24 which is held in place utilizing any suitable means such as friction or a clamp. Connector 24 couples outlet port 13 to a cooling device via line 25 to permit product pumped from the product source by pump 19 to be delivered into the cooling device.

Quick connect interface 10 includes gas port 14 because, in this preferred embodiment, pump 19 is a gas powered pump. Accordingly, gas port 14 receives connector 26 which is held in place using any suitable means such as friction or a clamp. Connector 26 couples gas port 14 to a gas source (e.g., a $CO_2$ bottle) to provide pump 19 with the gas that powers it. Although pump 19 has been described as gas powered, one skilled in the art will recognize that a gas powered pump is not required. If gas port 14 were eliminated, a different type of pump (e.g., an electrically powered pump) could be substituted.

Once inlet port 12, outlet port 13, and gas port 14 have been connected to the product source, the cooling device, and the gas source, respectively, housing 11 is secured within the drink dispensing system. Housing 11 may be mounted within a beverage dispensing system using any suitable means however, in this preferred embodiment, screws are placed within holes 15–18 and threadably secured to a bracket mounted within the drink dispensing system. Holes 15–18 include a recessed portion in the front of housing 11 so that the heads of the screws utilized to secure housing 11 within the drink dispensing system do not interfere with the mounting of pump 19.

Figure 4:
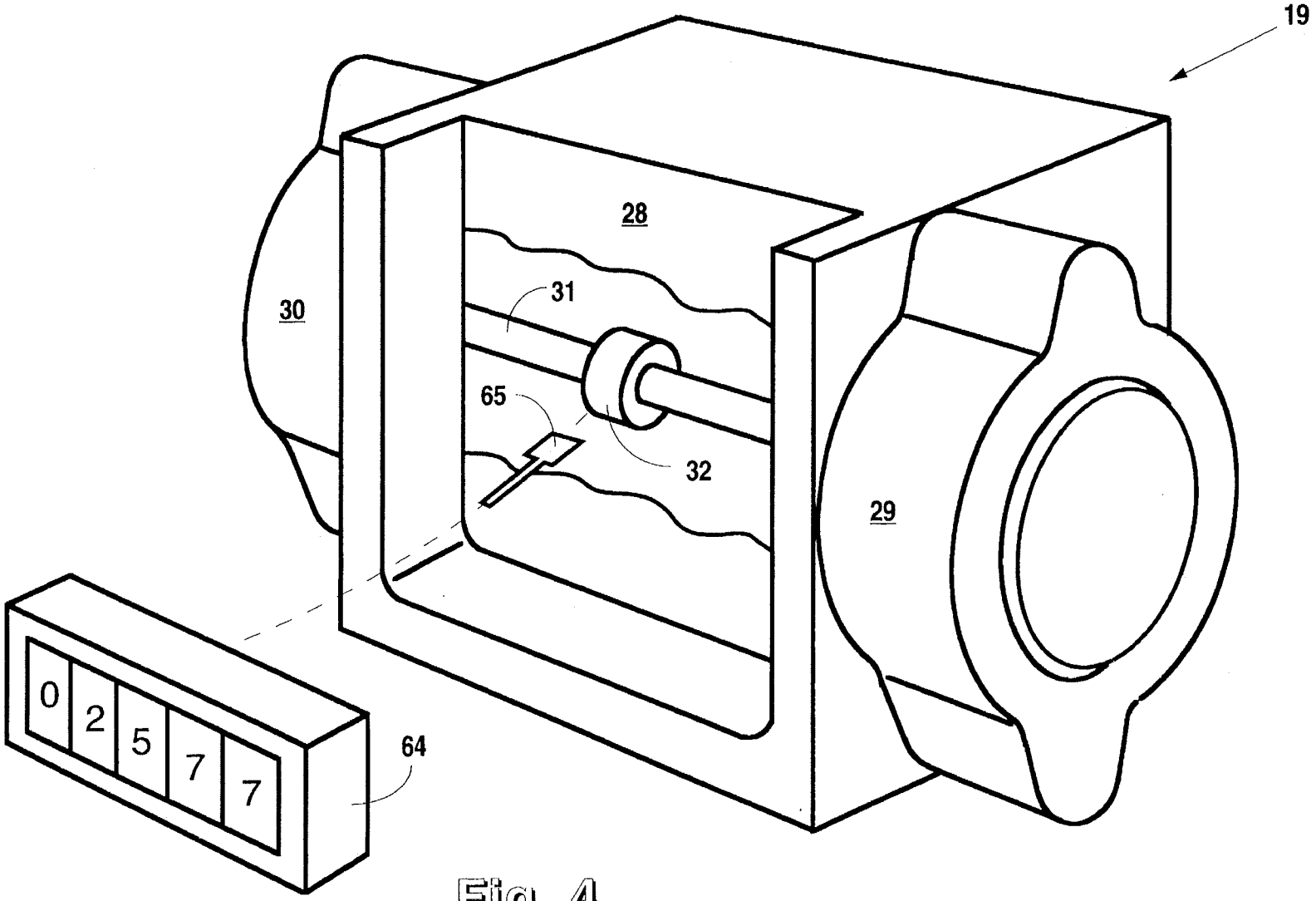
FIG. 4 is a perspective view in partial cross-section illustrating the flow volume counter for the pumping apparatus of the present invention.

For the purpose of illustration and to aid in the understanding of the invention, a pump suitable for implementing pump 19 will be described. As illustrated in FIGS. 1, 2, and 4, pump 19 includes housing 28 and enclosures 29 and 30. Each enclosure 29,30 includes a diaphragm that divides it into a product chamber and a gas chamber. The diaphragms within enclosures 29 and 30 are connected by piston rod 31 which includes ring 32 (see FIG. 4).

Housing 28 includes inlet channel 33 which communicates with both inlets into the product chambers of enclosures 29 and 30. The inlets into each product chamber includes a one-way valve so that once product has entered a product chamber it cannot flow back into inlet channel 33. Housing 28 further includes outlet channel 34 which communicates with the outlet from each of the product chambers. These outlets also include a one-way flow valve to prevent product from flowing back into the product chamber.

Similarly, housing 28 includes gas channel 35 which communicates with the gas chambers within enclosures 29 and 30. The inlets from gas channel 35 into the gas chambers each include a two-way valve that either inlets gas into the gas chamber or vents gas within the gas chamber external to pump 19. Additionally, housing 28 includes cavities 36 and 37 which receive protrusions 20 and 21 to aid in the attachment of pump 19 to quick connect interface 10.

Thus, in operation, when the drink dispensing system is activated, the gas source delivers gas into gas channel 35 via gas port 14. At any given time, valve within one gas channel 35 vents gas external to pump 19 and one permits gas to flow into its respective gas chamber. Consequently, one gas chamber vents external to pump 19, while the second gas chamber receives gas to expand the diaphragm toward the product chamber. Because the diaphragms are interconnected, the expansion of the one diaphragm towards the product chamber pulls the other diaphragm away from the product chamber. As the one diaphragm travels away from the product chamber, the product chamber expands in size, resulting in a differential pressure that draws product into it from the product source via inlet port 12 and inlet channel 33. Conversely, as the other diaphragm travels towards the product chamber, the product chamber contracts in size, resulting in product being forced from it into the cooling device via outlet channel 34 and outlet port 13. Delivery of gas to one gas chamber and venting of gas from the other gas chamber occurs until the motion of piston rod 31 causes ring 32 to trip the two-way valves. As a result, the positions of the two-way valves switch such that the vented gas chamber receives gas and the opposite gas chamber vents the gas previously delivered.

The alternate delivery and then venting of gas to the gas chambers reciprocally drives the diaphragms within enclosures 29 and 30. That reciprocating motion alternately draws product from the product source to the product chambers and then expels the product to the cooling device. Accordingly, pump 19 pumps product to the cooling device to replenish product dispensed from the cooling device by the drink dispensing system. Pump 19 delivers product to the cooling device until the drink dispensing system is deactuated. Upon the deactuation of the drink dispensing system, the gas source no longer delivers gas into pump 19 via gas port 14.

Quick connect interface 10 improves over present pump connection methods because pump 19 slides easily onto it and there is no requirement that difficult to use connection devices such as threaded fittings and/or clamps be employed. No connection devices are required because pump 19 resides on and is held firmly in place by inlet port 12, outlet port 13, gas port 14, and protrusions 20 and 21. Furthermore, inlet port 12, outlet port 13, and gas port 14 each include a respective groove 38, 39, and 40 which receives a respective O-ring 41, 42, and 43 which prevents leakage of either product or gas from the connection point between quick connect interface 10 an pump 19.

Additionally, quick connect interface 10 eliminates the leakage of product and gas presently experienced when pump 19 is removed from a drink dispensing system. As illustrated in FIG. 3, quick connect interface 10 includes flow controllers 80 and 90. Flow controllers 80 and 90 include valves 44 and 45, respectively. Housing 11 includes channels 46 and 47 which communicate with inlet port 12 and outlet port 13, respectively, to permit the placement of valve 44 within inlet port 12 and valve 45 within outlet port 13. That is, valve 44 threadably attaches to channel 46 such that flow control ball 50 resides within the passageway through inlet port 12. Similarly, valve 45 threadably attaches to channel 47 such that flow control ball 51 resides within the passageway through outlet port 13.

Flow controllers 80 and 90 include washers 48 and 49 which reside within the passageways through inlet port 12 and outlet port 13, respectively, to provide a seat for flow control balls 50 and 51, respectively. Flow controllers 80 and 90 further include O-rings 52 and 53 which fit around valves 44 and 45, respectively, to fluidly seal each of their respective channels 46 and 47. After valves 44 and 45 have been placed in their respective channels 46 and 47, retainer 54 is connected to housing 11 using screws 55–57 to prevent the removal of valves 44 and 45.

Flow controllers 80 and 90 prevent the leakage of product when pump 19 is removed from quick connect interface 10 by allowing the sealing of inlet port 12 and outlet port 13. Specifically, when pump 19 resides on quick connect interface 10, valves 44 and 45 are placed in the position shown in FIG. 1 to align the passages through flow control balls 50 and 51 with the passageways through inlet port 12 and outlet port 13, respectively. Consequently, flow of product to and from pump 19 occurs. However, to prevent flow, valves 44 and 45 are rotated approximately one quarter of a turn which pivots the passage through each of flow control balls 50 and 51 out of alignment with the passageways through inlet port 12 and outlet port 13, respectively, thereby sealing those ports and preventing the flow of product.

Quick connect interface 10 further includes flow controller 58 to prevent the escape of gas when pump 19 is removed from quick connect interface 10. Flow controller 58 is a valve that includes poppet 60 and spring 59 which resides against an annular protrusion within the passageway through gas port 14 to bias poppet 60. O-ring 61 fits around the point of poppet 60 to provide a seal against gas when pump 19 is not mounted on quick connect interface 10. Flow controller 58 further includes plug 62 which is sealed at the outlet from gas port 14 using any suitable means such as an adhesive to hold spring 59, poppet 60, and O-ring 61 within gas port 14.

With pump 19 removed from quick connect interface 10, spring 59 biases poppet 60 such that O-ring 61 fits within plug 62 and the point of poppet 60 protrudes through opening 63 of plug 62. As a result of the biasing of poppet 60 and O-ring 61 to this position, gas port 14 is sealed so that no gas escapes. However, when pump 19 resides on quick connect interface 10, gas channel 35 includes a protrusion that forces poppet 60 from opening 63 of plug 62, thereby permitting gas flow from the gas source into pump 19.

As illustrated in FIG. 4, pump 19 may be fitted with counter 64 to indicate the volume of fluid pumped through pump 19. Pick-up 65 connects to counter 64 and then counter 64 mounts to housing 28 such that pick-up 65 resides proximately adjacent to ring 32. Thus, as piston rod 31 reciprocates as previously described, ring 32 passes back and forth across pick-up 65. Each time ring 32 crosses pick-up 65, pick-up 65 triggers counter 64 to increase its count by one. Thus, pick-up 65 registers each stroke of piston rod 31 and triggers counter 64 to provide a cumulative count of the number of piston rod strokes. Accordingly, because the volume of fluid pumped from pump 19 during each stroke of piston rod 31 is a known quantity, the total volume pumped from pump 19 can be easily calculated using the total number of strokes performed by piston rod 31 as measured registered on counter 64. Therefore, pump use can be easily calculated to determine if the pump should be replaced. Although a mechanical pick-up has been described, one of ordinary skill in the art will recognize that any type of pick-up such as an electrical one may be substituted.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

We claim:

1. An apparatus for pumping, comprising:

a pump interface including an inlet port and an outlet port;

a pump including a fluid inlet thereto and a fluid outlet therefrom wherein said inlet port engages said fluid inlet to support said pump and inlet a fluid into said pump and said outlet port engages said fluid outlet to support said pump and outlet the fluid from said pump.

2. The apparatus for pumping according to claim 1 wherein said pump interface further comprises a flow controller for preventing the flow of fluid from said inlet port when said pump is removed from said pump interface.

3. The apparatus for pumping according to claim 1 wherein said pump interface further comprises a flow controller for preventing the flow of fluid from said outlet port when said pump is removed from said pump interface.

4. The apparatus for pumping according to claim 1 wherein said pump further includes a gas inlet.

5. The apparatus for pumping according to claim 4 wherein said pump interface further comprises a gas port that engages said gas inlet to support said pump and inlet a gas into said pump.

6. The apparatus for pumping according to claim 5 wherein said pump interface further comprises a flow controller for preventing the flow of gas from said gas port when said pump is removed from said pump interface.

7. The apparatus for pumping according to claim 1 wherein said pump further includes at least one cavity.

8. The apparatus for pumping according to claim 7 wherein said pump interface includes at least one protrusion that engages said at least one cavity to support said pump.

9. The apparatus for pumping according to claim 1 wherein said pump interface includes means for mounting onto a structure.

10. The apparatus for pumping according to claim 2 wherein said flow controller for said inlet port comprises a valve positioned within said inlet port wherein said valve is movable from a first position that permits the flow of fluid through said inlet port to a second position that prevents the flow of fluid through said inlet port.

11. The apparatus for pumping according to claim 3 wherein said flow controller for said outlet port comprises a valve positioned within said outlet port wherein said valve is movable from a first position that permits the flow of fluid through said outlet port to a second position that prevents the flow of fluid through said outlet port.

12. The apparatus for pumping according to claim 6 wherein said flow controller for said gas port comprises a valve.

13. The apparatus for pumping according to claim 12 wherein said valve for said gas port, comprises:

a plug including an aperture positioned over said gas port;

means for biasing residing within said gas port; and a poppet residing within said gas port between said means for biasing and said plug wherein said means for biasing biases said poppet into the aperture of said plug.

14. The apparatus according to claim 1 further comprising means for providing an indication of the volumetric flow of a fluid through said pump wherein said pump includes a chamber, an inlet into the chamber, an outlet from the chamber, means for drawing the fluid through the inlet into the chamber and forcing the fluid from the chamber through the outlet, and means for driving the means for drawing and forcing fluid, said means for providing an indication of volumetric flow, comprising:

a pick-up positioned proximately adjacent the means for driving wherein said pick-up registers the motion of the means for driving; and a counter connected to said pick-up wherein said counter increments in response to said pick-up registering the motion of the means for driving.

15. The apparatus according to claim 14 wherein said counter provides a cumulative count of the motion of the means for driving.

16. A quick connect pump interface, comprising:

a housing;

an inlet port on said housing for supporting a pump and inletting a fluid into the pump;

an outlet port on said housing for supporting the pump and outletting fluid from the pump;

a flow controller for preventing the flow of fluid from the inlet port when the pump is removed; and a flow controller for preventing the flow of fluid from the outlet port when the pump is removed.

17. The quick connect interface according to claim 16 further comprising a gas port on said housing for supporting the pump and for inletting gas into the pump.

18. The quick connect interface according to claim 17 further comprising a flow controller for preventing the flow of gas from said gas port when the pump is removed.

19. The quick connect interface according to claim 16 wherein said housing includes at least one protrusion for supporting the pump.

20. The quick connect interface according to claim 16 wherein said housing includes means for mounting onto a structure.

21. The quick connect interface according to claim 16 wherein said flow controller for said inlet port comprises a valve positioned within said inlet port wherein said valve is movable from a first position that permits the flow of fluid through said inlet port to a second position that prevents the flow of fluid through said inlet port.

22. The quick connect interface according to claim 16 wherein said flow controller for said outlet port comprises a valve positioned within said outlet port wherein said valve is movable from a first position that permits the flow of fluid through said outlet port to a second position that prevents the flow of fluid through said outlet port.

23. The quick connect interface according to claim 18 wherein said flow controller for said gas port comprises a valve.

24. The quick connect interface according to claim 23 wherein said valve for said gas port, comprises:

a plug including an aperture positioned over said gas port;

means for biasing residing within said gas port; and a poppet residing within said gas port between said means for biasing and said plug wherein said means for biasing biases said poppet into the aperture of said plug.

* * * * *